United States Patent [19]

Ohtsuka

[11] Patent Number: 4,518,252

[45] Date of Patent: May 21, 1985

[54] METHOD OF RECORDING PIECES OF IMAGE INFORMATION OF DIFFERENT KINDS IN ELECTROPHOTOGRAPHY

[75] Inventor: Shuichi Ohtsuka, Asaka, Japan

[73] Assignee: Fuji Photo Film Co., Ltd., Japan

[21] Appl. No.: 433,626

[22] Filed: Oct. 8, 1982

[30] Foreign Application Priority Data

Oct. 19, 1981 [JP] Japan ..... 56-166793

[51] Int. Cl.[3] ..... G03G 13/22

[52] U.S. Cl. ..... 355/133; 355/7; 355/40; 355/77

[58] Field of Search ..... 355/7, 16, 40, 77, 133

[56] References Cited

U.S. PATENT DOCUMENTS

| | | | |
|---|---|---|---|
| 2,892,446 | 6/1959 | Olden | 355/16 X |
| 3,141,394 | 7/1964 | Cunningham et al. | 355/16 X |
| 3,427,658 | 2/1969 | Roberts | 355/16 X |
| 3,533,692 | 10/1970 | Blanchette et al. | 355/16 |
| 3,785,730 | 1/1974 | Weber et al. | 355/40 X |
| 3,950,652 | 4/1976 | Yamashita | 355/40 X |

*Primary Examiner*—Fred L. Braun

*Attorney, Agent, or Firm*—Murray, Whisenhunt & Ferguson

[57] ABSTRACT

A process for recording and classifying different kinds of image information in an electrophotographic recording system in which a recording medium in the form of a rollfilm is processed through the steps of charging, exposure to an image pattern, developing the exposed film with a toner and fixing the so-developed image on the film. The recording medium is divided into a plurality of sections, each section being utilized to record only a particular kind of image information thereby facilitating retrieval of the recorded information. Image information can be recorded after old information has already been recorded, developed and used.

4 Claims, 2 Drawing Figures

METHOD OF RECORDING PIECES OF IMAGE INFORMATION OF DIFFERENT KINDS IN ELECTROPHOTOGRAPHY

BACKGROUND OF THE INVENTION

1. Field of the Invention

This invention relates to a method of recording pieces of image information of different kinds in corresponding classifications on a photosensitive medium in the form of rollfilm by electrophotography. The term, "image information" hereinafter used is intended to mean letters, figures, photographs and other patterns which can be recorded and reproduced (or which can be displayed by projection on a screen).

2. Description of the Prior Art

As a medium for storing such pieces of image information microfilms have come into widespread use. For the purpose of recording a large volume of image information use is made of silver halide photosensitive material or diazophotosensitive material in the form of rollfilm, microfiche or punched cards. Or account of their relatively large storage capability inspite of their small size, rollfilms and microfiches have gained general popularity and have come into wide use. Sixty or more frames (or pieces) of image information can be stored on a single microfiche sheet. The microfiche is advantageous for storing pieces of image information of different kinds in corresponding classifications. This is not the case with rollfilm. Also, the microfiche is advantageous for retrieval different kinds of image information.

Advantageously a large amount of image information can be stored if a rollfilm is used. It is, however, impossible to take full advantage of such rollfilm unless it is necessary to record a large amount of image information, i.e. enough to fill the full length of the rollfilm. In making a record on a rollfilm, pieces of image information are recorded as they occur (or in the order of their appearence) irrespective of the kind of image information. Thus the series of pieces of image information on the full length of the rollfilm are in random order as regards classification. Therefore, the retrieval of a desired kind of image information is time and labor consuming. Thus, there has been a demand for classifying and recording pieces of image information according to their kinds.

With a view to meeting this demand there has been proposed a record producing method as follows: a rollfilm having pieces of image information recorded thereon is extended and cut as long as the width of a flat jacket; and the resultant film strips are sequentially put in the flat jacket in rows, thus constituting a flat sheet similar to a microfiche. In the proposed method the number of frames exposed at one time in recording is twelve, and their equivalent length is equal to the width of a jacket, much less than the number of frames exposed at one time in making a record on a 60 frame microfiche. Of course, when recording less than twelve pieces of image information, the remaining blank frames on a single strip of film will not be used, and be wasted. The number of wasted frames will be small, compared with the other kinds of microfilm recording.

Like the ordinary microfiche, the "jacketed" microfiche stores only a fraction of the image information which can be stored in a single rollfilm, and therefore a large number of microfiches will have to be used to store as much image information as a single rollfilm can store, and the difficulty in maintenance and the storage space required will increase accordingly.

Thus, there has been an ever increasing demand for a recording medium which is capable of storing as much image information as a rollfilm which still allowing the recording of a fraction of the total frames at one time, and permitting classification of pieces of image information in terms of their kinds in recording.

This demand is hardly satisfied by the microfilms made of silver halide photosensitive material, which cannot be partially and selectively used for recording without impairing the remaining blank frames of the rollfilm or microfiche. Specifically, in some instances the remaining blank frames are undesirably exposed to light, and are thus spoiled. Otherwise, the remaining length which has not been exposed to light, will be spoiled during development of the length used. At the time of projecting and displaying selected frames bearing image information on a screen it is next to impossible to keep the remaining unused frames from being exposed to light, preventing the unused part from exposure to the light of projection. It is also difficult to shut out light from the unused part of a microfilm or microfiche when they are changed for the purpose of recording or while storing such partly used microfilms or microfiches. When a desired piece of image information in a partly used microfilm is selected and read with a projector, it will be necessary to locate the desired frame on the microfilm with the aid of non-optical means beforehand because otherwise, the retrieval operation will cause the exposure of the unused part of the microfilm to the light of projection, thus spoiling it. The reliance on non-optical means will not permit the retrieval of a desired frame in the microfilm with the eyes. Obviously, such non-optical retrieval system would be useless in practical applications. Also, it is necessary to provide fail-safe means to prevent inadvertent overstepping across the used-and-unused boundary into unused part of a microfilm when reading with a projector because otherwise, the unused part will be exposed to the light of projection, and be spoiled. There are presumably a variety of fail-safe means, but these require extra tedious work at the time of recording, and are commercially useless.

The present inventor found that all the defects mentioned above can be overcome simply by using electrophotography. Specifically, whether exposed to light or not, electrophotographic photosensitive material can be reused. Even a material which has been developed can if it has not been fixed be subjected to cleaning, and then reused. Thus, it is unnecessary to shut off light in using a selected part of a electrophotographic photosensitive microfilm. As long a part of electrophotographic photosensitive microfilm as required can be used even if the amount of image information to be recorded at one time is less than that which is enough to fill the full length of extended rollfilm, and the partly used rollfilm can be read with an optical means, while still keeping the unused part in condition for later use.

SUMMARY OF THE INVENTION

The object of this invention is to provide a method of recording pieces of image information of different kinds in accordance with their groups of classification on a electrophotographic photosensitive rollfilm even if those pieces of image information of different kinds appear one after another in random sequence.

To attain this object according to this invention a method of recording pieces of image information of different kinds by catagory on a recording medium which takes the form of microfilm comprises the steps of: dividing the full length of a electrophotographic photosensitive rollfilm into as many sections as the kinds of image information as required; and recording pieces of image information of each different kind on the section of the rollfilm allotted to the kind. The recording is made by subjecting a electrophotographic photosensitive rollfilm to charging with electricity, exposing it to an image or pattern, and developing and fixing the image or pattern on the electrophotographic photosensitive film. When it is desired that the so-recorded images or patterns be projected on a screen, the electrophotographic photosensitive film used must be one which has a transparent and electrically conductive support, an overlying transparent photo-conductive layer and, if required, an outermost insulating layer.

According to this invention the full lengths of the electrophotographic photosensitive rollfilm is divided into a predetermined number of sections, each including a plurality of frames; pieces of image information to be recorded at one time are allotted to the sections of the rollfilm and are recorded according to their kinds; and then the partly used rollfilm can be subjected to retrieval with an optical means without spoiling the unused length of the rollfilm. Thus, if there is a need for recording additional pieces of image information on the same rollfilm, they can be recorded sequentially on the unused part of each section according to their kinds.

Each section of the rollfilm may be identified with a proper marking, as for instance printing on the electrophotographic photosensitive material, electrophotographic recording thereon or magnetic recording on a magnetic material applied onto the electrophotographic photosensitive film. These markings are applied at given intervals on the full length of the rollfilm. Alternatively, a frame counter may be used to determine the sections of the rollfilm in terms of counts. In the former identification, for instance, markings, "Section A", "Section B". . . are provided at predetermined lengths (for instance, at one hundred-frame intervals), whereas in the latter identification, for instance, "Section A" runs from count 0 to count 99; "Section B" runs from count 100 to count 199 and so forth.

DESCRIPTION OF THE PREFERRED EMBODIMENTS

Figure 1:
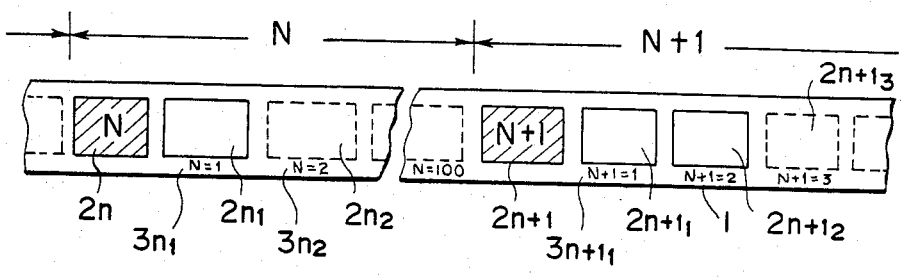
FIG. 1 shows a electrophotographic photosensitive rollfilm which is extended and divided into a predetermined number of sections according to this invention.

Referring to FIG. 1, there is shown a part of an extended length of rollfilm 1, which is made of a electrophotographic photosensitive material. As shown in this drawing, in the longitudinal direction of the rollfilm 1 identification frames 2n, 2n+1. . . appear ahead of each train of a predetermined number (for instance, one hundred) of frames 2n1, 2n2 . . . 2n100; $2n+1_1$, $2n+2_2$ . . . $2n+1_{100}$; $2n+2_1$, $2n+2_2$. . . , which frames together constitute subsequent sections N, N+1, . . . . Identification numbers N, N+1 . . . appear in respective identification frames. For instance, in the Nth section, the frames marked 2n1, 2n2 . . . are utilized for recording. The first frame which is marked 2n1 and is shown in solid lines in the Nth section has a piece of image information recorded thereon, and the second and subsequent frames which are shown in broken lines, remain blank.

In the N+1th section the first and second frames $2n+1_1$ and $2n+1_2$ (solid lines) have pieces of image information of the same kind recorded thereon (although of different kind from those in the Nth section), and the third and subsequent frames $2n+1_3$. . . remain blank. The blank frames in different sections can be filled later with pieces of image information of different kinds as necessary. Advantageously, frame numbers 3n1, 3 n2 . . . may be recorded in the margins of the frames to indicate their numbers.

FIG. 1 shows rectangular frames printed or recorded on the rollfilm beforehand. Alternatively, the image of a square frame may be recorded together with a piece of image information on an unused part of the rollfilm. This simultaneous recording is advantageous in that the number of frames in each section can be determined depending on the amount of information (the amount of later-added image information inclusive).

An identification-free rollfilm can be used. In this case, a frame counter may be used to count the number of frames each time a piece of image information has been recorded, and the numbers of the used frames are recorded by their addresses in a notebook. Specifically assume that the numbers of one hundred frames 0–99 belong to Section 1; the numbers of one hundred frames 100–199 belong to Section 2 and so forth. Then, while watching the counter, sixteen pieces of image information of kind "A" are recorded sequentially on frames 0–15 (Section 1), and thereafter, twenty-one pieces of image information of kind "B" are recorded sequentially on frames 100–120 (Section 2), and finally, seven pieces of image information of kind "E" are recorded sequentially on frames 400–406 (Section 5). When there is a need to record additional pieces of image information of kind "A", the recording can started from the 16th frame (Section 1), the position of which can be determined with the aid of the counter.

As another example of identifying the sections of the rollfilm, a magnetic material may be applied to the beginning of each section in the form of stripes, and the stripes can be selectively magnetized so that they may be used in automatic retrieval. First, the full length of a rollfilm is divided in as many sections as the kinds of image information as required for storage. For instance, in preparing an employees' personnel file, one section which comprises, for instance, fifty frames, is allotted to a single employee, who is identified by a number. Magnetic stripes ahead of each section are selectively magnetized to indicate the identification number. When there is a need to record pieces of personal information, a right section is automatically determined with the aid of a magnetic retrieval means, and the pieces of individual information are recorded on blank frames by electrophotography. The position of the beginning of the unused length of the section can be determined from the optical state of darkness or lightness in the used or unused frames. Otherwise, magnetic stripes may be applied to the margin of the last frame of the used ones or to the margin of the first frame of the unused ones, and then the location of the first frame of the unused length can be determined in terms of magnetic stripes which have been magnetized at the end of previous recording.

Magnetic stripes can be used as boundary marks for aiding in locating desired sections both at the time of recording pieces of image information and at the time of projecting and displaying them.

An ordinary electrophotographic recording apparatus can be used in recording pieces of image information sequentially in a electrophotographic photosensitive rollfilm.

Figure 2:
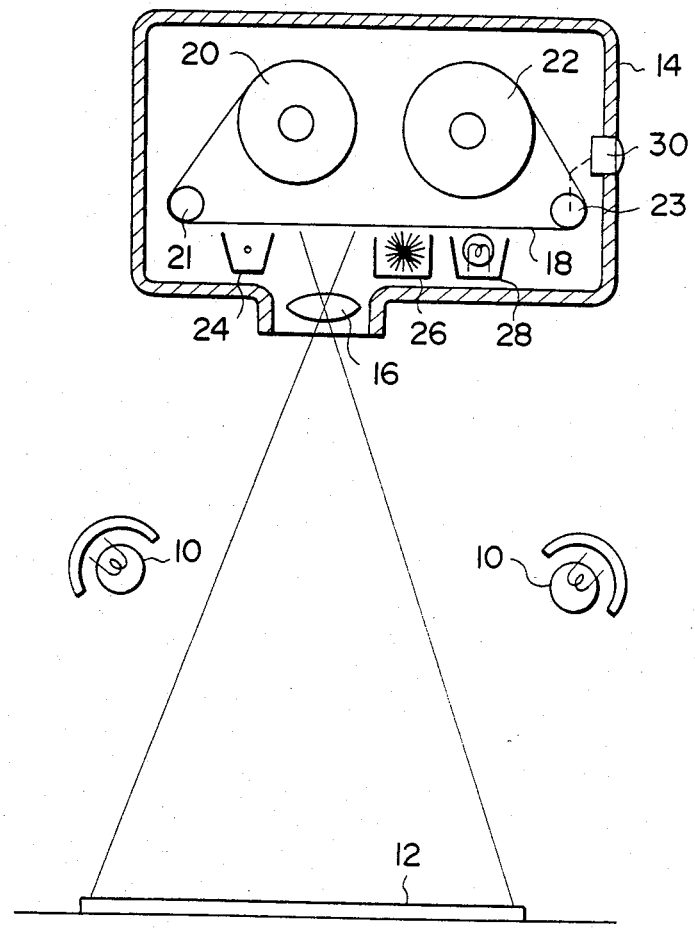
FIG. 2 shows diagramatically a electrophotographic recording apparatus which can be used in recording pieces of image information on a rollfilm according to this invention.

Referring to FIG. 2, there is shown such a electrophotographic recording apparatus. A manuscript 12 bearing pieces of image information to be recorded is illuminated by lamps 10, and a selected piece of image information is projected onto a electrophotographic photosensitive film 18 with the aid of a lens, which is fitted to a housing 14. The electrophotographic sensitive film 18 is made to advance from an unwinding roll 20 to a winding roll 22 via guide rolls 21 and 23. Between these guide rolls 21 and 23 are provided a charging unit 24, a projecting lens 16, a developing unit 26, and a fixing unit 28 in the order named. Thus, the advancing electrophotographic photosensitive film 18 is subjected frame by frame to charging, exposing, developing and fixing processes. The rollfilm is preferably contained in a cassette (not shown), and the cassette is detachably mounted in position in the housing 14. The guide roll 23 is operatively connected to a frame counter 30 to indicate which number of frame has been used. From the count of the frame counter 30 proper sections are selected so that pieces of image information of different kinds may be recorded in the so-selected sections according to their kinds.

An ordinary resettable counter can be used, and it counts one every time a frame has passed by the lens. When the beginning of the rollfilm is set in proper position the counter is reset, and while recording pieces of image information of different kinds, the numbers given to the beginning or first frames of different sections are written in a notebook.

As is understood from the above, a method of recording pieces of image information of different kinds permits: recording as many pieces of image information as required at one time according to their kinds in a recording medium which takes the form of rollfilm; and quick retrieval access to a desired piece of image information the recorded in the rollfilm thanks to classification and recording.

I claim:

1. A method of permanently recording and classifying pieces of image information of different kinds according to their kinds on a single recording medium of rollfilm for intermittent image information retrieval and image information supplementation comprising, providing an electrophotographic photosensitive rollfilm of predetermined length having a plurality of sequential frames thereon, said rollfilm being activatable in a frame-by-frame manner to record image information thereon and when not activated being unaffected by information retrieval;

demarcating the full length of the electrophotographic photosensitive rollfilm into as many sections as the kinds of image information to be recorded, each said section containing a sequence of said plurality of frames; and recording sequentially as many pieces of image information as required at one time on proper sections of said rollfilm according to their kinds, each section corresponding to one of said kinds of image information, said recording step comprising charging at least one frame of said electrophotographic photosensitive rollfilm with electricity to activate said frame for recordation of image information, said frame belonging to a section which is allotted to the kind of image information to be recorded, exposing the frame to the image of a pattern representing the piece of image information, to form an electrical image on said rollfilm, developing the so-formed electrical image of the pattern with toner, to form a toner image, and permanently fixing said toner image on said frame of said rollfilm, whereby image information can be permanently recorded on said rollfilm and classified at the time of recordation according to the kind of image information for rapid retrieval of image information and said image information can be retrieved without affecting the ability of the rollfilm to record additional image information.

2. A recording method according to claim 1 further comprising the step of selectively magnetizing magnetic stripes in the margin of the beginning of each section of the rollfilm to identify the section.

3. A recording method according to claim 1 wherein the electrophotographic photosensitive rollfilm is transparent.

4. A recording method according to claim 1 wherein the first frame of each section of the rollfilm bears an identification pattern, such as a number letter or mark.

* * * * *